US006595363B2

(12) United States Patent
Peters

(10) Patent No.: US 6,595,363 B2
(45) **Date of Patent: *Jul. 22, 2003**

(54) FLORAL SHIPPER

(75) Inventor: Gerald E. Peters, Miami, FL (US)

(73) Assignee: Professional Package Company, Strongsville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/195,862

(22) Filed: Jul. 15, 2002

(65) Prior Publication Data

US 2002/0185399 A1 Dec. 12, 2002

Related U.S. Application Data

(63) Continuation of application No. 09/317,933, filed on May 24, 1999, now Pat. No. 6,419,087.

(51) Int. Cl.[7] ..... B65D 85/52; B65D 21/00; A01G 9/02

(52) U.S. Cl. ..... 206/423; 206/499; 47/84

(58) Field of Search ..... 47/73, 83, 84; 206/423, 386, 499, 504; 229/120, 143, 157, 916

(56) References Cited

U.S. PATENT DOCUMENTS 2,801,742 A * 8/1957 Farrell ..... 206/499
3,021,046 A * 2/1962 Pullen ..... 206/423
3,284,949 A * 11/1966 Park ..... 206/423
4,113,093 A * 9/1978 Hendrickx ..... 206/423
4,330,059 A * 5/1982 Freeman ..... 206/423
5,690,275 A * 11/1997 Bose et al. ..... 229/120
6,419,087 B1 * 7/2002 Peters ..... 206/423

* cited by examiner

*Primary Examiner*—Mickey Yu
*Assistant Examiner*—Gregory Pickett
(74) *Attorney, Agent, or Firm*—Renner, Otto, Boisselle & Sklar, LLP

(57) ABSTRACT

A floral shipper comprising an inner container for supporting a floral grouping therein in an upright position and an outer container sized to receive therein the inner container and the upright floral grouping. The outer container has a bottom wall and a plurality of side walls extending upwardly therefrom. At least some of the side walls have a heightened portion that is greater than the height of the inner container and the floral grouping and have disposed therein ventilation openings for allowing air to circulate within the outer container. The ventilation openings are disposed in the at least some of the side walls so that when two or more outer containers are oriented adjacent one another, at least some ventilation openings of one outer container align with the ventilation openings of the adjacent outer container. A floral shipper assembly comprises a plurality of floral shippers and a pallet for supporting the floral shippers, wherein each shipper includes a width and length dimension such that when a plurality of the shippers are oriented adjacent one another, the overall width and overall length of the adjacent shippers substantially matches the respective width and length of the pallet onto which the floral shippers are arranged.

3 Claims, 5 Drawing Sheets

FLORAL SHIPPER

CROSS REFERENCE TO RELATED APPLICATION

This application is a continuation of Ser. No. 09/317,933 filed May 24, 1999, now U.S. Pat. No. 6,419,087.

FIELD OF THE INVENTION

The present invention relates to a floral shipper assembly for shipping flowers and, more particularly, a floral shipper that provides efficient use of space and ventilation to the flowers contained in the shipper.

BACKGROUND OF THE INVENTION

Floral shippers are used for shipping and presenting flowers. Prior art floral shippers typically comprise a round-shaped plastic container, also known in the art as a wet container, and a cardboard container surrounding the plastic container. A bunch, or grouping, of flowers is placed into the plastic container. Water is then poured into the plastic container to a desired level. The plastic container is then placed into a plastic bag that extends upward and surrounds the flowers. One or more of the plastic containers are then placed into the cardboard container, which is typically rectangular-shaped and has a height greater than that of the flowers. Cut-outs are provided a few inches below the top of and in the sides of the cardboard container for enabling the container to be grasped and lifted and for providing ventilation into the container during shipping. Before transporting large quantities of the floral shippers, the shippers are assembled on one or more standard-sized shipping pallets generally in side-by-side and stacked formation. Together, the two containers provide protection for and ventilation to the flowers.

These prior art floral shippers and the methods of shipping them have not satisfactorily kept up with the needs of the growing floral industry. As many flowers are shipped intercontinentally, the designs of floral shippers need to incorporate more efficient use of transportation space without compromising the quality of the flowers they carry and display.

By placing the round-shaped plastic container into the rectangular container the space in the corners of the rectangular container go unused. The plastic bag into which the round container is placed prevents air from the cut-outs from circulating around and in between the flowers, especially since the plastic bag usually is above the level of the cut-outs. Moreover, even without the plastic bags the flowers themselves tend to block the cut-outs and prevent air circulation.

When the floral shippers are assembled as an assembly onto a pallet, much of the available space of the pallet goes unused. This is because manufacturers of prior art floral shippers have typically placed greater emphasis on the accommodation of a predetermined amount of flowers rather on the means of shipping the flowers. Thus, for example, when multiple floral shippers of different sizes and shapes are assembled one on top of the other and/or side-by-side on a pallet, there is uneven and, consequently, unuseable space above the top of the shippers and/or to the side of the shippers. Moreover, because the containers vary so much in size and shape, there is no certainty or predictability as to whether a particular assembly of containers will cause one container to inhibit airflow to or from an adjacently-stacked container, in which case the quality of the flowers may be compromised. Over a period of time and a number of shipments, this unuseable space and uncertainty in stacking formations creates inefficiencies in cost, inconveniences when attempts are made to maximize space, and possible degradation in the quality of the flowers shipped.

There is a need for a floral shipper that provides the benefits of protecting and displaying flowers and that may be combined with other floral shippers while maximizing use of transportation space. In addition, there is a need for a floral shipper that can be quickly assembled, easily grasped and moved, and be assembled with other floral shippers with predictable and efficient use of space.

SUMMARY OF THE INVENTION

The present invention comprises a floral shipper assembly including an inner container for supporting a floral grouping therein in an upright position and an outer container sized to receive therein the inner container and the upright floral grouping. The outer container has a bottom wall and a plurality of side walls extending upwardly therefrom. At least some of the side walls have a heightened portion that is greater than the height of the inner container and the floral grouping. At least some of the side walls have disposed therein ventilation openings for allowing air to circulate within the outer container. The ventilation openings are disposed in the at least some of the side walls so that when two or more outer containers are oriented adjacent one another, at least some ventilation openings of one outer container align with the ventilation openings of the adjacent outer container.

The outer container is preferably sized to receive therein the inner container and the floral grouping, although the outer container may be sized to accommodate two or more of the inner containers and the upright floral grouping.

The ventilation openings are preferably disposed in opposing side walls of the outer container. This promotes cross ventilation on the inside of the outer container. Even more preferably, at least some of the ventilation openings are disposed immediately above the height of the inner container in the heightened portion of the side walls. At least some of the ventilation openings may also form slots in the outer container sized to permit fingers of the human hand to fit at least partially therethrough. The slots facilitate grasping the floral shipper and moving it from one location to another.

In a preferred embodiment, at least a portion of the periphery of the inner container matches and slidably engages the inside surface of one or more of the side walls of the outer container. The ventilation openings are disposed at a top edge of the at least some of the side walls for providing a path for air to circulate across and throughout an upper region of the outer container. Preferably, the plurality of side walls comprises at least two width side walls each having a width dimension and two length side walls each having a length dimension, wherein when two or more floral shippers are oriented side-by-side along their width dimension, the ventilation openings in the width side walls automatically align and provide a first path for air circulation across the shippers and when at least one of the two or more floral shippers is oriented side-by-side along the length dimension with another floral shipper, the ventilation openings in the length side walls automatically align and provide a second path for air circulation across the shippers that is transverse to the first path. This causes the paths to impinge one another, thereby causing the air to stir up, or circulate, randomly throughout the inside of the outer container.

In another preferred embodiment, the inner container includes a bottom wall and a plurality of side walls extending upwardly therefrom and the inner container side walls are set off from the outer container side walls by a lip extending outwardly from at least some of the inner side walls of the inner container. Even more preferably, the four side walls are substantially equal in height and form a substantially rectangular-shaped container.

In another preferred embodiment, the inner container includes an outwardly extending lip adjacent a top edge of at least some of the side walls of the inner container wherein the lip corresponds to and slidably engages at least a portion of the inside surface of the outer container. The side walls of the inner container may be tapered inwardly to facilitate stacking of the inner containers. Preferably, the side walls of the inner container include outwardly extending ribs extending substantially from the top to the bottom of the inner container for positioning and guiding the inner container into the outer container.

According to another aspect of the invention, a floral shipper assembly comprises a plurality of floral shippers and a pallet for supporting the floral shippers. Each floral shipper of the assembly includes a width and length dimension such that when a plurality of the shippers are oriented adjacent one another, the overall width and overall length of the adjacent shippers substantially matches the respective width and length of the pallet onto which the floral shippers are arranged.

In a preferred embodiment, the width and length of the floral shippers are 10 inches and 16 inches, respectively, and the width and length of the pallet are 40 inches and 48 inches, respectively, so that the assembly comprises four floral shippers oriented widthwise and three floral shippers oriented lengthwise. Preferably, the floral shippers include side walls having ventilation openings disposed therein such that when the shippers are aligned adjacent to one another the openings line up with one another to permit air to circulate from within one floral shipper to within the adjacent floral shipper.

DETAILED DESCRIPTION OF THE INVENTION

Figure 1:
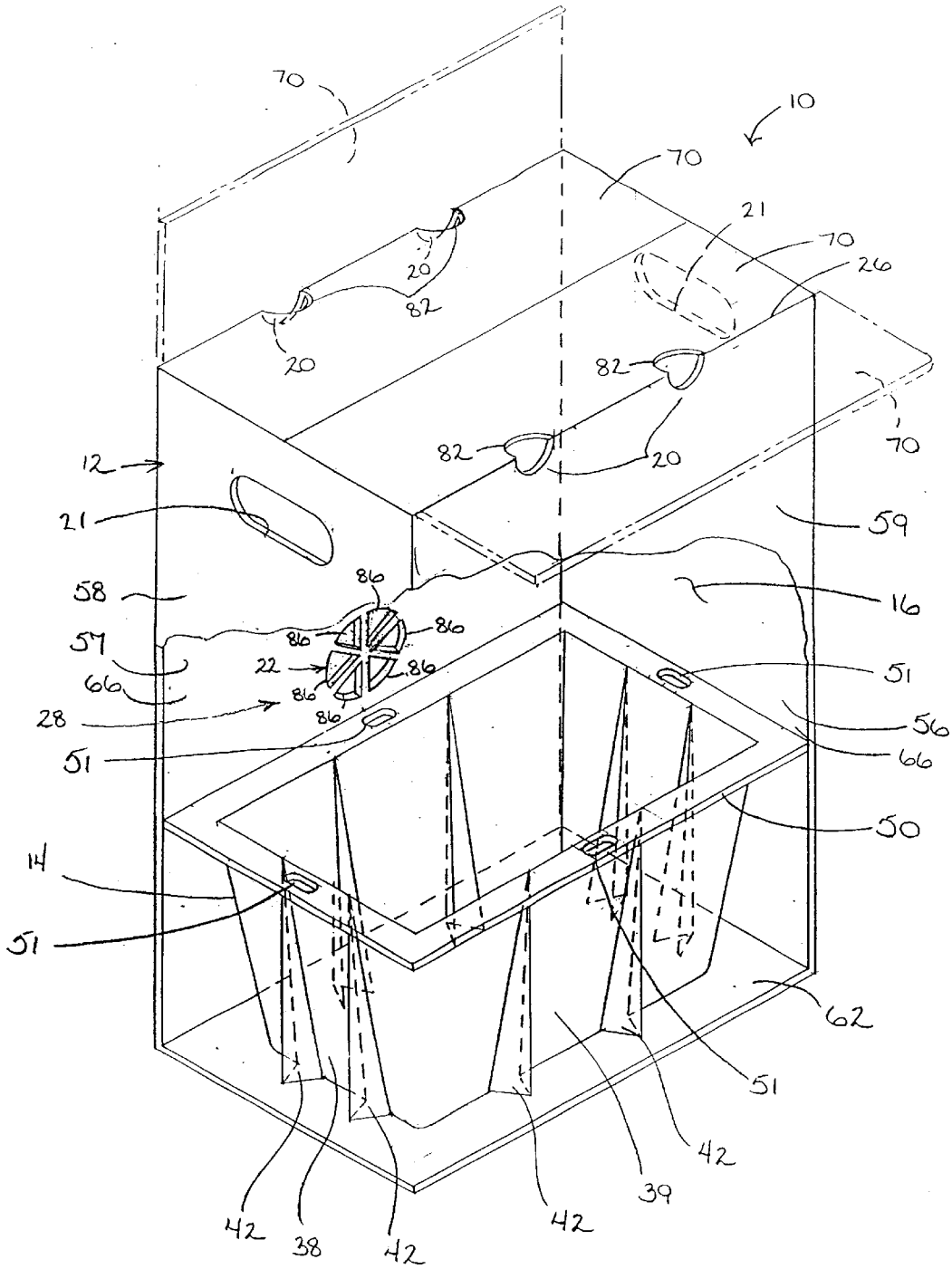
FIG. 1 is a perspective view of a floral shipper constructed in accordance with the present invention showing an outer container having a portion broken away for showing an inner container.

Referring now in detail to the Figures, there is shown in FIG. 1 a floral shipper constructed in accordance with the present invention generally indicated at reference numeral 10. In the illustrated embodiment, the floral shipper 10 includes an outer container 12 and a relatively shorter inner container 14 adapted to fit into the outer container 12. Water is poured into the inner container 14 to a desirable level. Flowers are then placed into the inner container 14 and the inner container 14 is lowered into the outer container 12. The flowers extend upright into an upper region 16 of the outer container 12, the upper region 16 being that region within the outer container 12 that is above the inner container 14.

Figure 6:
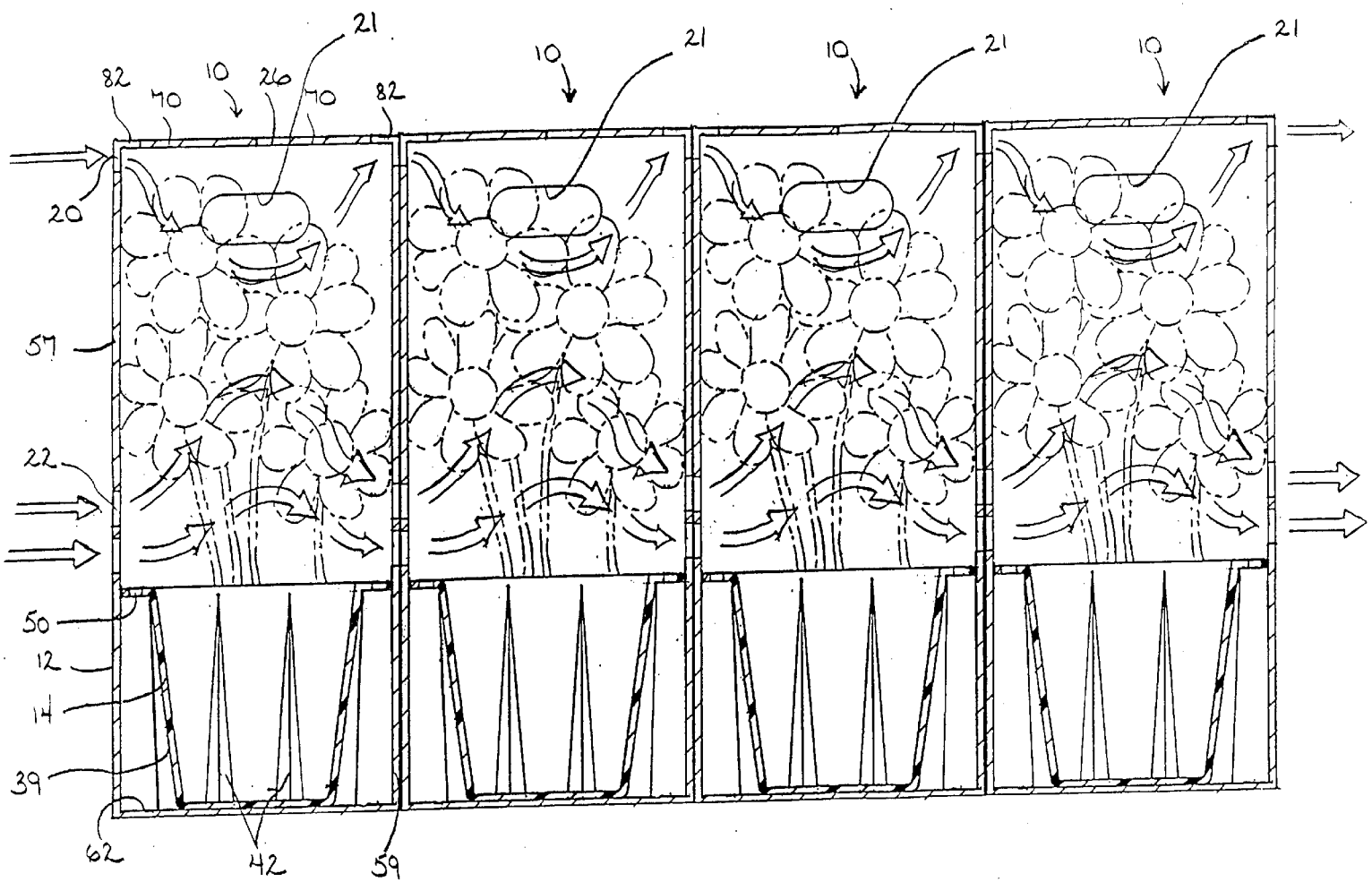
FIG. 6 is a cross-sectional view of an assembly of four adjacent floral shippers of FIG. 1 as viewed from the plane 5—5 in FIG. 1 showing flowers included therein in phantom and including arrows representing a path of air circulation through the adjacent shippers.

The outer container 12 includes ventilation openings 20, 21, 22 disposed, respectively, at a top edge 26, below the top edge 26, and approximately at the center 28 of the outer container 12 for circulating air through the outer container 12 during shipping. Advantageously, when two or more floral shippers 10 are oriented side-by-side, as shown in the assembly of FIG. 6, the ventilation openings 20, 22 automatically align and provide a path for air circulation across the shippers 10. Likewise, when two or more floral shippers 10 are oriented front to back, as shown in the assembly of FIG. 7, the ventilation openings 21 automatically align and provide a path for air circulation across the shippers 10 that is transverse to the path of air circulating through the openings 20, 22.

Figure 7:
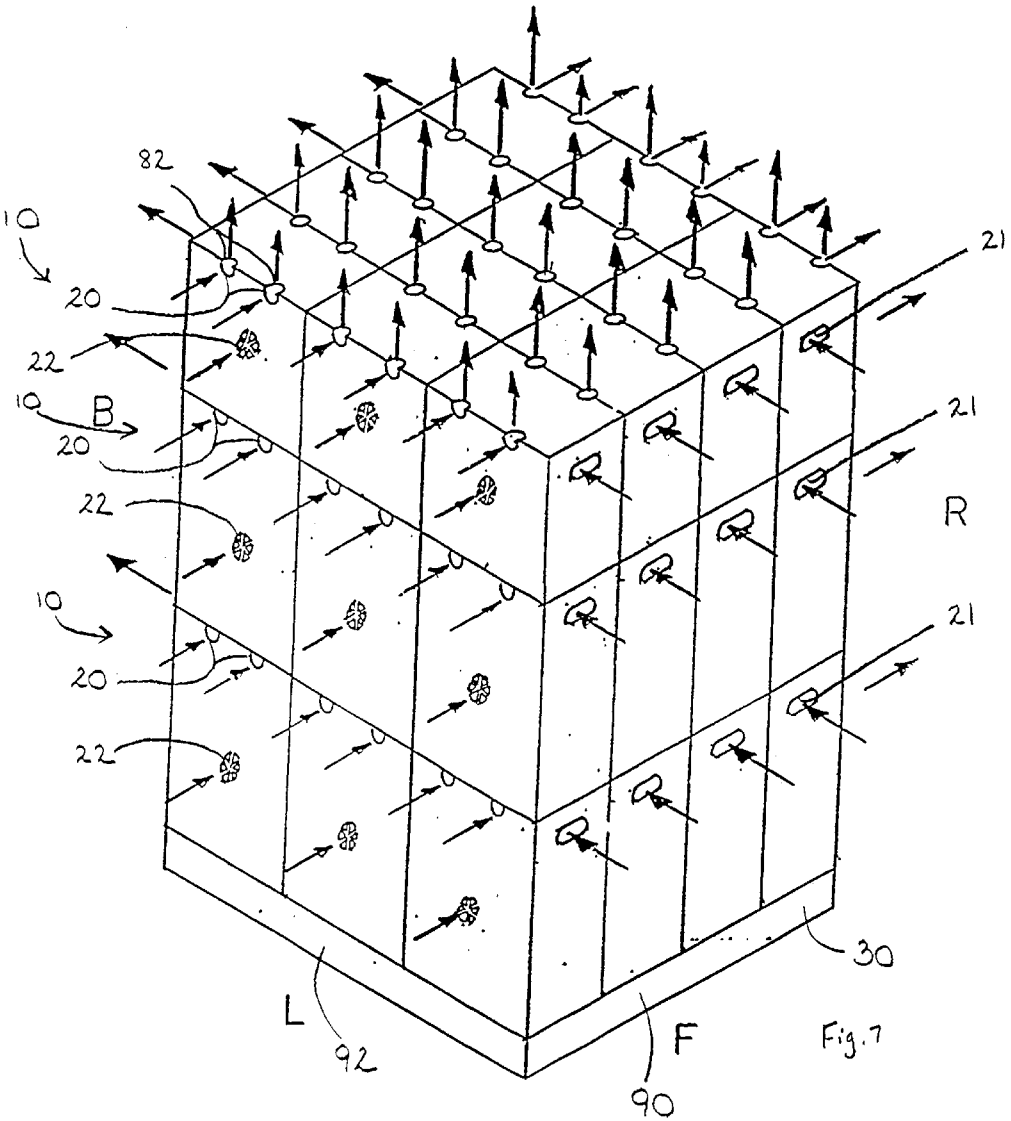
FIG. 7 is a perspective view of a floral shipper assembly of 36 side-by-side and stacked floral shippers of FIG. 1 and including arrows representing a path of air circulation through the arrangement of shippers.

As seen in FIG. 7, when multiple floral shippers 10 are stacked as an assembly onto a pallet 30, substantially all of the top surface area of the pallet 30 is used. In other words, the combination of the widths and lengths of the floral shippers 10 substantially matches the respective width and length of the pallet 30. These and other advantages, as well as the structure, function and features of the floral shipper 10 are described in greater detail below.

Figure 4:
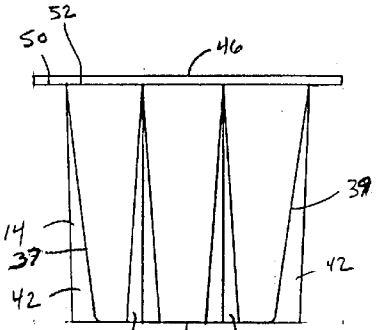
FIG. 4 is an end elevation view of the inner container of FIG. 1.
Figure 2:
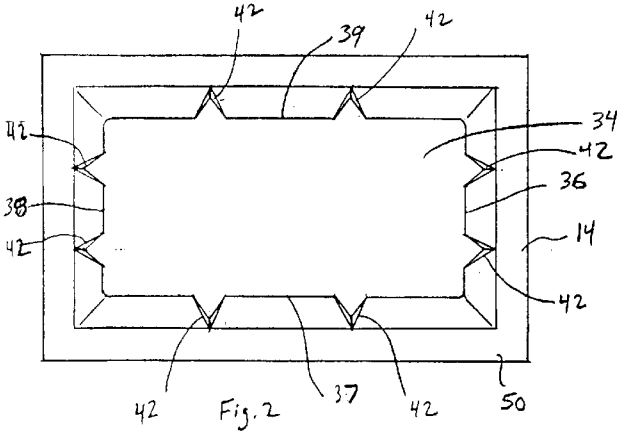
FIG. 2 is a bottom view of the inner container of FIG. 1.
Figure 3:
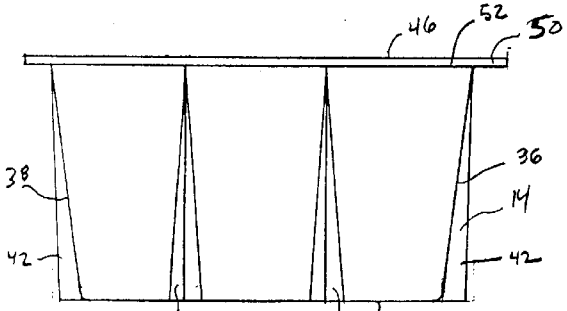
FIG. 3 is a side elevation view of the inner container of FIG. 1.

As shown in FIGS. 2–4, the inner container 14, which, if desired, can be used independently of the outer container 12 to ship flowers, is preferably made of molded plastic, although other suitable polymeric materials may be used. The inner container 14 is substantially rectangular in shape; that is, there are four sides and four right angles and, therefore, the rectangular shape may also comprise a square, as will be described in greater detail below. The rectangular shape is advantageous over round-shaped containers. When a round-shaped container is tipped, the bottom of the container has point contact and, consequently, unstable contact with its supporting surface. When the rectangular-shaped container 14 is tipped, support is along the entire width or length of the container, providing better stability. Also, as a round-shaped container is tipped the water flows toward a point, whereas in the rectangular shaped container 14 the water flows over the width or length of the container 14 which allows the rectangular-shaped container 14 to be tipped several degrees more than the round-shaped container before water begins to flow therefrom.

The rectangular-shaped inner container 14 also makes more efficient use of space than a round-shaped container of comparable volume. When round-shaped containers are placed onto a pallet or into a rectangular-shaped receiving container, the space in the corners of the pallet or receiving container and the space between the round shaped containers goes unused. The rectangular-shaped inner container 14 of the present invention, in contrast, readily fits into such corners, thereby using more of the available volumetric capacity on the pallet 30 or in the outer container 12 than could otherwise be used by round-shaped containers.

In the exemplary illustrated embodiment, the inner container 14 includes a bottom wall 34 and four side walls 36–39 that extend upwardly from the bottom wall 34. Common edges of the side walls 36–39 and bottom wall 34 are preferably rounded to prevent sharp, or concentrated, contact with, for example, the outer container 12, or handling equipment that may be used during handling of the inner container 14. Side supports, or flying buttresses 42, stiffen the side walls 36–39 and distribute the weight of and the load carried by the inner container 14 over a wider surface area of the bottom 34 of the inner container 14. The edges of the side supports 42 are also preferably rounded (not shown).

As shown in FIG. 2, there are preferably two side supports 42 disposed on each side wall 36–39. The side supports 42 position and guide the inner container 14 into the outer container 12 as the former is lowered into the latter. As shown in FIGS. 3 and 4, the side supports 42 are preferably triangular in shape and extend gradually outward and, therefore, provide gradually increased strength to the side walls 36–39 from the top 46 to the bottom 34 of the inner container 14. This increased strength is desirable since when water is poured into the inner container 14 the force exerted by the water on the side walls 36–39 is greater at the bottom 34 than at the top 46 of the inner container 14. As shown in FIGS. 3 and 4, the side walls 36–39 and side supports 42 are preferably tapered inwardly from the top 46 to the bottom 34 of the inner container 14. This taper facilitates stacking of a plurality of the inner containers 14.

Figure 5:
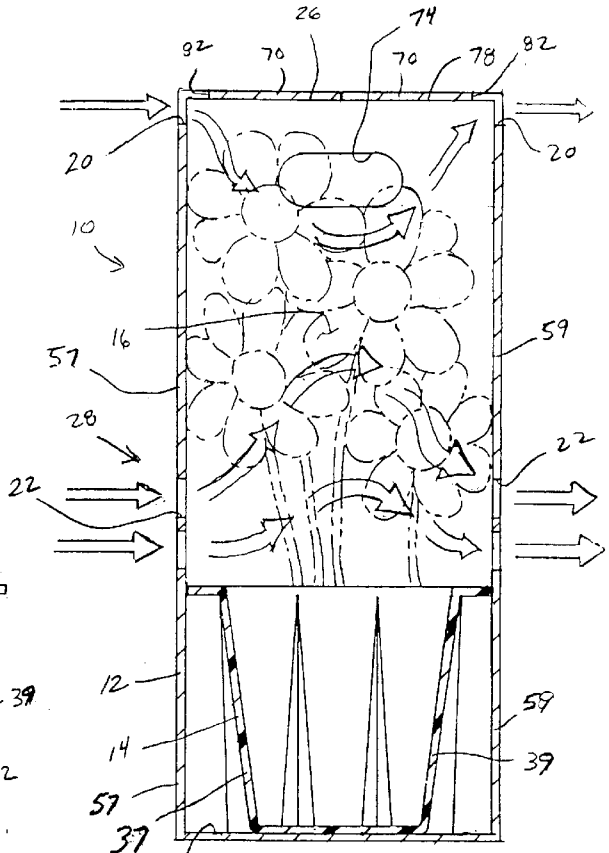
FIG. 5 is a cross-sectional view of the floral shipper of FIG. 1 as viewed from the plane 5—5 in FIG. 1 showing flowers included therein in phantom and including arrows representing a path of air circulation through the shipper.

The side walls 36–39 include an outwardly extending lip 50 adjacent a top edge 52 of the side walls 36–39. The lip 50 preferably includes one or more slots 51 sized to permit fingers of the human hand to grasp any of the sides 36–39 of the inner container 14 for the raising and/or lowering thereof. The lip 50 provides additional stiffness to the inner container 14, especially at the midpoints of the side walls 36–39. When grasping and picking up an inner container 14 containing water and flowers therein, the lip 50 inhibits stresses that may otherwise tend to flex, or bow, the side walls 36–39 inwardly and/or outwardly at the midpoints of the side walls 36–39. As shown in FIG. 5, the lip 50 also sets off the side walls 36–39 of the inner container 12 by a gap, G, from four corresponding side walls 56–59 of the outer container 12. This set-off G protects flower stems from being cut or otherwise damaged when the outer container 12 is cut and removed for displaying the flowers contained in the inner container 14.

As can be appreciated by the foregoing, the inner container 14 provides a stiff yet lightweight structure for holding water and a floral grouping. The inner container 14 also is of a convenient size and exhibits somewhat of an aesthetically pleasing look for presenting flowers.

Referring now again to FIG. 1, the outer container 12 is also rectangular in shape and is preferably made of corrugated cardboard. Corrugated cardboard provides stiffness to the overall structure of the floral shipper 10 and is light in weight for easy handling during assembly. Moreover, corrugated cardboard provides a resilient, or shock absorbing, structure for the inner container 14 and, consequently, a floral grouping, during shipping. The outer container 12 is formed from a cardboard blank by hand or by a cardboard carton forming machine.

Figure 9:
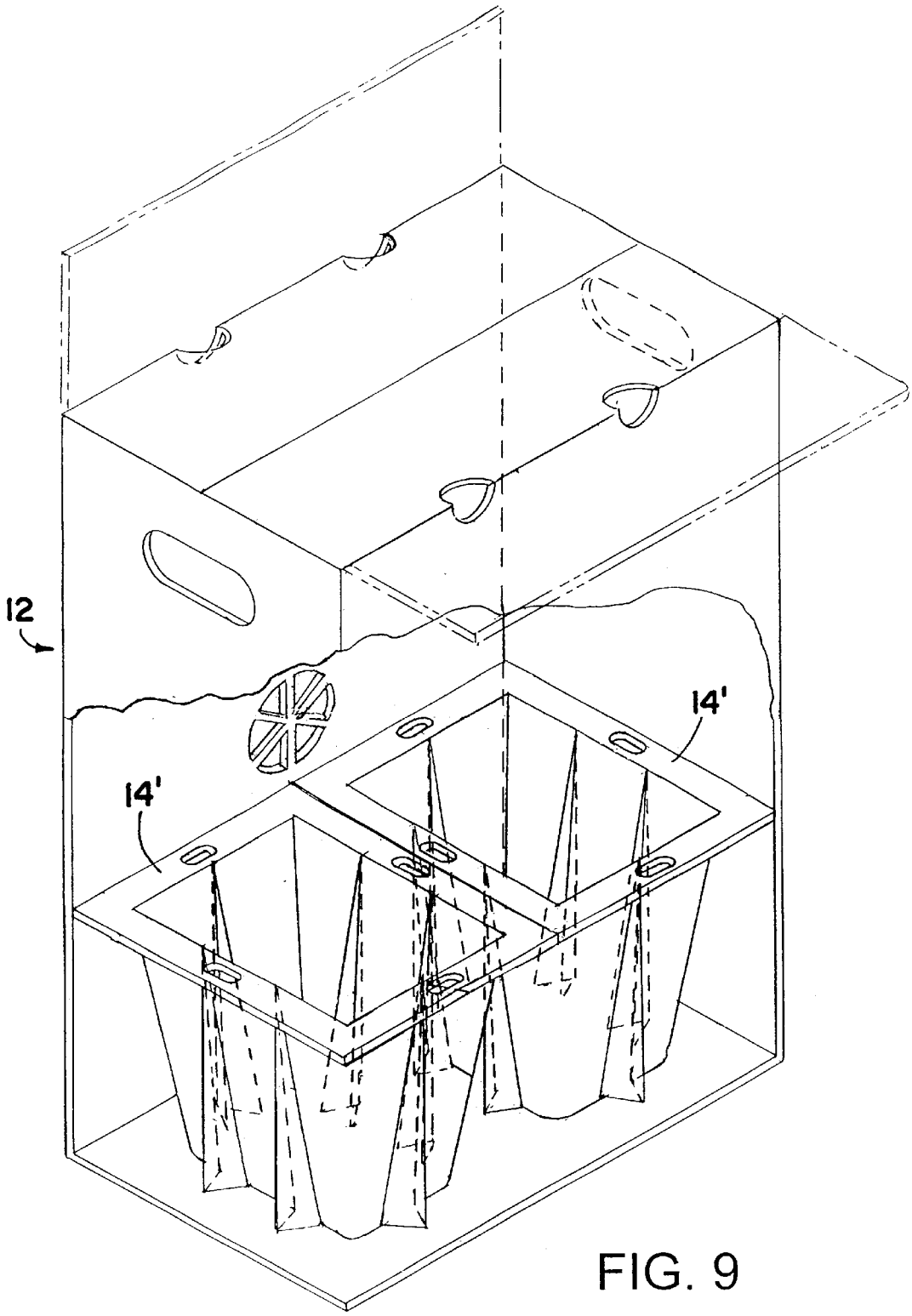
FIG. 9 is a perspective illustration of a floral shipper with two inner containers within a single outer container.

In its assembled form, the outer container 12 includes a bottom wall 62 and width side walls 56, 58 and length side walls 57, 59 that extend upwardly from the bottom wall 62. It should be noted that the terms width and length are herein used in relation to distinguishing relatively different sides of the outer container 12 shown in the illustrated embodiment. The side walls 56–59 are greater in height than the side walls 36–39 of the inner container 14. Also, the width and length of the side walls 56–59 of the outer container 12 are greater than the respective width and length of the side walls 36–39 of the inner container, including the respective width and length of the lip 50 extending outwardly from the side walls 36–39. In the illustrated embodiment, the inner container 14 is adapted to fit into the outer container 12 in nesting relationship. In this regard, as the inner container 14 is lowered into the outer container 12 and guided by the side supports 42, the periphery of the lip 50 slidably engages an inside surface 66 of the side walls 56–59 of the outer container 12 (FIG. 5). The inner container 14 nests in a lower region, for example, as shown in the illustrated embodiment, on the bottom wall 62, of the outer container 12 while the upper region 16 of the outer container 12 remains free for flowers to extend upwardly therein. Of course, the inner container 14 or outer container 12 may be sized so that two or more inner containers 14'fit into the outer container 12 in a side-by-side nesting relationship (FIG. 9).

The length side walls 57, 59 of the outer container 12 also include hinged top panels 70 that can be selectively closed (shown in solid lines in FIG. 1) or opened (shown in phantom lines in FIG. 1). When closed, the top panels 70 abut one another and are secured together preferably with adhesive tape (not shown). Of course, additional top panels 70 may be hinged at the width side walls 56, 58 and taped together to form a double top panel support for providing additional stiffness and overall strength to the floral shipper 10.

The ventilation openings 21 disposed below the top edge 26 of and in the width sides 56, 58 of the outer container 12 provide a path for air circulation across the upper region 16 of the floral shipper 10. The openings 21 are also sized to permit fingers of the human hand to fit therethrough to grasp the sides 56, 58 of the outer container 12 for the raising and/or lowering thereof. The openings 21 are disposed sufficiently close to the top edge 26 of the outer container 12 to enable easy access thereto.

Ventilation openings 20 are disposed at the top edge 26 of the length side walls 57, 59 and ventilation openings 22 are disposed approximately at the center 28 thereof. The top edge ventilation openings 20 are adjacent to top panel openings 82 located in the top panels 70. The openings 20 and 82 are preferably round-shaped to prevent or substantially reduce the likelihood of tearing of the outer container 12 due to, for example, stress concentrations exhibited during handling.

As illustrated by the arrows shown in FIG. 5, the top edge ventilation openings 20 allow air to positively circulate across and throughout the uppermost region of the outer container 12. Because the top edge ventilation openings 20 are located in the side walls 57, 59, in contrast to the top panels 70, during shipping they positively receive air, for example, as the floral shipper assemblies 10 are moved during transportation. In addition, the top edge openings 20 of the side walls 57, 59 act as chimneys for releasing humid and/or hot air from the inside of the outer container 12, whether the floral shipper assemblies 10 are in transit or remain idle. The top panel ventilation openings 82 also release humid and/or hot air unless, of course, they are covered by another floral shipper 10, for example, when the shipper assemblies 10 are stacked one on top of the other on the pallet 30. The top edge ventilation openings 20 are located above the upward extent, or the heads, of the flowers, thereby preventing the flowers from interfering with the cross flow of air through the top edge openings 20. To this end, the location of the top edge ventilation openings 20 will vary according to the type of flowers desired to be shipped. As shown in FIG. 5, if the heads of the flowers are spaced a gap, D, from the top edge 26 of the container, the ventilation openings 20 may be positioned, accordingly, anywhere within the gap.

The size of the ventilation openings 20 and 82 will likewise vary according to the type of flowers shipped. Some flowers will require larger amounts of ventilation requiring larger-sized openings while other flowers will require less ventilation and smaller-sized openings. In the exemplary illustrated embodiment the ventilation openings 20 and 82 are about 1 ½ to 2 inches in radius Referring more closely now to FIG. 1, the central ventilation openings 22 are preferably located above where the lip 50 of the inner container 14 is in slidable contact with the inner surface of the side walls 57, 59. These openings 22, as well as the side openings 51 in the lip 50, allow air to exhaust from underneath the inner container 14 as the inner container 14 is lowered into the outer container 12.

In the exemplary illustrated embodiment, the central openings 22 comprise a plurality of spaced apart pie wedge-shaped openings 86. The wedge openings 86 allow substantially the same amount of air through the outer container 12 as if the opening was circular with the same radius as the pie wedges 86. However, the arrangement of the wedge openings 86 shown in FIGS. 1 and 7 provide greater stacking strength in the side walls 57, 59 along the vertical axis than if circular openings were in the side walls 57, 59. It will be appreciated that the central openings 86 may comprise other shapes and sizes to accomplish the same effect of air circulation through the upper region of the container and stackability, and such other shapes and/or sizes are contemplated as falling within the scope of the present invention.

Referring now to FIG. 6, there is seen an assembly of four floral shippers 10 in cross-section wherein the floral shippers 10 are oriented adjacent to one another. As alluded to above, each outer container 12 includes width sides 56, 58 and length sides 57, 59. As shown in FIG. 6, the ventilation openings 20, 22 automatically align when the length sides 57, 59 of the outer containers 12 are oriented side-by-side. In a similar manner, as shown in the assembly of FIG. 7, the ventilation openings 21 automatically align when the width sides 56, 58 are oriented front to back. In this regard, the floral shippers 10, when assembled together, allow air to circulate across the upper regions 16 of the outer containers 12 from one outer container 12 to an adjacent outer container 12, and so on in series.

Advantageously, the location of the ventilation openings 20–22 in the side walls 56–59 of the outer containers 12 provides multiple paths of constant air flow throughout the floral shippers 10. The top edge openings 20 of the length side walls 57, 59 as well as the ventilation openings 21 therebelow in the width side walls 56, 58 provide a path for air to circulate between and around the heads of flowers while the central ventilation openings 22 provide a path for air to circulate between and around the stem regions of the flowers. As can be appreciated by the foregoing, the air flow path through the ventilation openings 20, 22 is transverse to the air flow path through the ventilation openings 21 which causes the paths to impinge one another, thereby causing the air to stir up, or circulate, randomly throughout the inside of the outer containers 12.

Referring to the assembly of floral shippers 10 shown in FIG. 7, air is circulated from the floral shippers 10 shown in the far left of FIG. 7 (indicated generally by L) to the floral shippers 10 shown in the far right of FIG. 7 (indicated generally by R) and, likewise, from the shippers 10 shown in the front of FIG. 7 (indicated generally by F) to the shippers 10 in the back of FIG. 7 (indicated generally by B). It should be noted that the terms left, right, front, and back are herein used in relation to the relative orientation of the shippers 10 shown in the illustrated embodiment. This flow is facilitated by the outer containers 12 being substantially rectangular-shaped from top 26 to bottom 62 which, as most clearly shown in the assemblies of FIG. 6 and 7, ensures that there is relatively little, if any, space between adjacent containers 12 into which air may be diverted. Consequently, from left to right and/or front to back of the assemblies air is guided through the ventilation openings 20–22 yet stays substantially within the boundaries defined by the side walls 56–59, top panels 70 and bottom walls 62 of the respective outer containers 12.

As shown in the assembly of FIG. 7, the floral shippers 10 are oriented side-by-side, front to back, and stacked one on top of the other on the pallet 30. To facilitate the most efficient use of space on the pallet 30 and a compact relationship between adjacent floral shippers 10, the width side walls 56, 58 and length side walls 57, 59 of the outer containers 12 are sized so that only a predetermined arrangement, or assembly, of the floral shippers 10 substantially matches the respective width 90 and length 92 of the pallet 30.

As shown in the illustrated embodiment, to accomplish such an arrangement the length side walls 57, 59 of one outer container 12 must be aligned with the length side walls 57, 59 of its adjacent outer container 12 and in a similar manner the width side walls 56, 58 of one outer container 12 must be aligned with the width side walls 56, 58 of its adjacent outer container 12. In accordance with the invention, the width 90 and length 92 of the pallet 30 as well as the width sides 56, 58 and length sides 57, 59 of the containers 12 are selected so that when the floral shippers 10 are arranged in the predetermined position, the ventilation holes 20, 22 in the length side walls 57, 59 of adjacent outer containers 12 automatically align with one another and the ventilation openings 21 in the width side walls 56, 58 of adjacent outer containers 12 likewise automatically align with one another.

In the exemplary illustrated embodiment, the pallet 30 comprises a standard-sized pallet that is 40 inches wide by 48 inches in length while the floral shippers 10 have a width of 10 inches and a length of 16 inches. The only suitable assembly of the floral shippers 10, as shown in FIG. 7, is a "4 wide×3 length" arrangement. In accordance with the invention, the arrangement permits the most efficient use of space as well as constant circulation of air within the shippers 10 during shipping. Of course, alternative pallets 30 and sizes and assemblies of floral shippers 10 may be employed to facilitate other predetermined arrangements which provide the dual benefit of efficient use of space and automatic alignment of ventilation openings 20–22, and such alternatives are contemplated as falling within the scope of the present invention.

Figure 8:
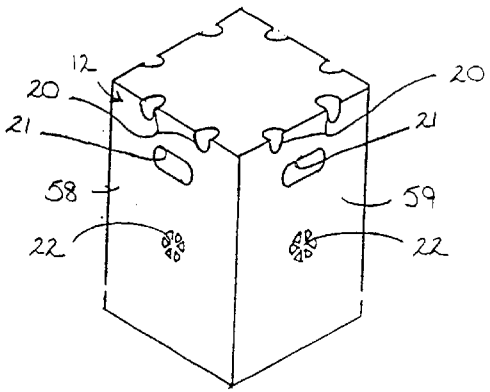
FIG. 8 is a perspective view of an alternative embodiment of the floral shipper constructed in accordance with the present invention.

Thus, for example, as shown in FIG. 8, the sides 56–59 of the outer container 12 may have equal lengths and widths and all of the sides 56–59 may include all of the afore-described ventilation openings 20–22. Accordingly, because the sides 56–59 are of equal length and width, any side 56–59 may be oriented adjacent any other side 56–59 in a particular assembly and the openings 20–22 therein will automatically align. The pallet 30 may be adapted to accommodate a predetermined quantity of such shippers 10. Such a pallet would have, for example, a width substantially equal to any multiple of the width or length of the floral shipper 10 and a length, likewise, substantially equal to any multiple of the width or length of the shipper 10.

The side wall ventilation openings 20–22 also allow the floral shippers 10 to be stacked one on top of the other without compromising the cross ventilation through adjacent floral shippers 10. As shown in the assembly of FIG. 7, when the floral shippers 10 are stacked, the ventilation openings 20, 22 of the length side walls 57, 59 permit cross ventilation through every level of floral shippers 10 on the pallet 30. This is advantageous over prior art floral shippers that exhaust exclusively from the top of the floral shipper structure. When such top exhaust floral shippers are stacked the openings are at least partially covered which inhibits air from circulating into the upper region of the stacked floral shippers. Moreover, top exhaust openings are not as effective in guiding air into the inside of the container as the side openings 20, 22 of the present invention since, for example, air flowing across the top exhaust floral shipper is more likely to flow over and/or around the shipper.

The stackable height of the assembly will depend on the height, vertical strength and arrangement of the individual outer containers 12. As shown in the illustrated embodiment, floral shippers 10 having similar heights are arranged on the same level. Thus, the floral shippers 10 on the top level in FIG. 7 have the same height as do the floral shippers 10 on the middle and lowest level.

Crush tests performed on the cardboard outer containers having a width of 10 inches and a length of 16 inches showed that the containers could withstand a 250 to 275 pound load without deforming or buckling. Such a strength permits the containers to be stacked three levels high, as shown in FIG. 7.

In view of the foregoing, it will be appreciated that several advantages are realized by the structure of the floral shipper 10 of the present invention. The rectangular-shaped outer container 12 is a unitary structure providing quick and easy assembly. The inner container 14 is simply filled with water, a floral grouping is placed therein, and then the inner container 14 is lowered into the outer container 12. The top panels 70 of the outer container 12 are then folded over and secured together with adhesive tape. Unlike some prior art floral shippers, the floral shipper 10 of the present invention does not require assembly of several segmented portions which take comparatively more time to assemble and may topple over if not properly secured.

Also, the rectangular-shaped floral shipper 10 is substantially planar on all sides 56–59 facilitating slidable contact between adjacent and stacked containers. This is advantageous when it is desired to stack one floral shipper 10 on top of another since once the bottom of the higher floral shipper 10 is raised onto a top edge of another floral shipper 10, the higher floral shipper 10 need only be pushed therefrom until it fully rests on the lower floral shipper 10. This simplifies stacking and reduces stacking time. Some prior art floral shippers, in contrast, require floral shippers having a boss portion on their bottom end to be lowered and aligned into a corresponding recess portion on the top end of the lower floral shipper.

The invention has been described with reference to the preferred embodiments. Obviously, however, modifications and alterations will occur to others upon the reading and understanding of this specification. It is therefore intended to include all such modifications insofar as they come within the scope of the appended claims or equivalents thereof.

What is claimed is:

1. A group of at least two floral shippers packed side-by-side, each shipper having:

an outer container having a rectangular base, four sidewalls each extending upwardly from a respective side of the base, and top wall, the top wall including at least two panels, each panel being connected to one of the sidewalls along a fold line, and at least one inner container having a periphery that conforms closely to at least a portion of an inside periphery formed by the vertical sidewalls of the outer container, the at least one inner container having a top rim spaced downward from the top wall of the outer container, the shippers being arranged with one side wall of the outer container of one shipper in face-to-face contact with one side wall of the outer container of the other shipper, and at least an opposed pair of sidewalls of each outer container having first ventilation openings immediately above the top rim of the at least one inner container, and second ventilation openings spanning the fold line between the top and side walls, the first ventilation openings aligning with each other to provide air circulation between containers and the second ventilation openings aligning with each other to provide air circulation between containers.

the at least one inner container having a generally rectangular base and walls that extend upward from the base and slope outwardly from the base, and wherein the inner containers are stackable, nesting within each other when not in the outer containers.

2. A The group of claim 1 wherein each outer container includes a pair of second ventilation openings in each fold line.

3. The group of claim 1 wherein each outer container includes two inner containers in a side by side arrangement.

* * * * *